US006729340B2

(12) United States Patent
Chen

(10) Patent No.: US 6,729,340 B2
(45) Date of Patent: May 4, 2004

(54) UMBRELLA WITH SWITCH FOR FOLDING AND OPENING UMBRELLA AUTOMATICALLY

(76) Inventor: Tien-Cheng Chen, No. 118, Sec. 2, Chang-Tsao Rd., He-Mei Chen, Changhua Hsien (TW)

( * ) Notice: Subject to any disclaimer, the term of this patent is extended or adjusted under 35 U.S.C. 154(b) by 0 days.

(21) Appl. No.: 09/843,721

(22) Filed: Apr. 30, 2001

(65) Prior Publication Data

US 2002/0157694 A1 Oct. 31, 2002

(51) Int. Cl.[7] ..... A45B 25/14
(52) U.S. Cl. ..... 135/24; 135/25.1; 135/25.4
(58) Field of Search ..... 135/24, 20.3, 25.1, 135/25.4, 40, 22, 25.41, 15.1

(56) References Cited

U.S. PATENT DOCUMENTS

| | | | | |
|---|---|---|---|---|
| 5,566,698 A | * | 10/1996 | Yu | 135/24 |
| 5,626,160 A | * | 5/1997 | Ko | 135/22 |
| 5,632,290 A | * | 5/1997 | Ling Kuo | 135/24 |
| 5,868,151 A | * | 2/1999 | Kuo | 135/22 |
| 6,176,246 B1 | * | 1/2001 | Lin et al. | 135/22 |
| 6,196,243 B1 | * | 3/2001 | Chen | 135/20.3 |
| 6,199,571 B1 | * | 3/2001 | Linn et al. | 135/20.3 |
| 6,257,257 B1 | * | 7/2001 | Lin et al. | 135/24 |

FOREIGN PATENT DOCUMENTS

| | | | | |
|---|---|---|---|---|
| GB | 2240038 | * | 7/1991 | 135/24 |

* cited by examiner

*Primary Examiner*—Lanna Mai
*Assistant Examiner*—Winnie Yip
(74) *Attorney, Agent, or Firm*—Bacon & Thomas

(57) ABSTRACT

A switch for folding and opening an umbrella automatically, comprises an engaging tube having a first spring and a second spring, and a buckle; one end of the engaging tube has a tube; a lateral side of the tube having a protrusion; two outer lateral sides of the engaging tube being installed with parallel lateral sides; a button for covering the engaging tube being exactly located upon the receiving space; a central post, a third spring, and a movable block being pivotally installed in the sliding groove, wherein the movable block can slid on the central post freely; a sleeve being a hollow tube for receiving the engaging tube; a post being protruded from another end; an embedding hole being installed on the post at the connection to the wall of the sleeve; an outer edge of the post being installed with an embedding body; and a handle being inserted by the sleeve; and the blind hole being formed with an embedding seat for being embedded by the embedding body. By above simple structure, the umbrella can be opened and folded easily. Further, by engagement of protrusion and embedding hole and the lateral side, the engaging tube and sleeve are combined. The alignment is performed easily and the time is saved.

4 Claims, 6 Drawing Sheets

UMBRELLA WITH SWITCH FOR FOLDING AND OPENING UMBRELLA AUTOMATICALLY

BACKGROUND OF THE INVENTION

The present invention relates to an umbrella, and especially to an umbrella with a switch for folding and opening an umbrella automatically, in that it is only necessary to press an button then, the objects of folding and opening an umbrella are achieved.

Umbrellas are a necessary tool in raining day or for shielding the radiation of sunlight. In general, the user is necessary to open an umbrella or folding an umbrella frequently as using an umbrella. Since the operation is repeatedly and frequently, a button for automatically an umbrella is developed. That is, the user is only necessary to press a button for opening an umbrella. However, only the problem of opening an umbrella is resolved, while the operation of folding an umbrella is not resolved, the user must fold the umbrella by hands. This is very inconveniently. Thus, there is an eager demand for a novel designed umbrella which can resolve the defect in the prior art.

The conventional umbrella invented by the inventor. In that, the user is only necessary to push one button for opening or folding an umbrella as illustrated in FIG. 1. In that, as the button 1 is pressed, a hook 2 will release the middle tube 3 so as to open the umbrella. Meanwhile, by a compressible spring 5, the sleeve 4 moving upwards to be below the hook 2, if it is desired to close the umbrella, it is only necessary to press the button 1 toward the press plate 6 of the sleeve 4 so that the buckling head 7 and the pressing spring 8 are pressed, then the buckling head 7 is released and thus, the umbrella is folded.

SUMMARY OF THE INVENTION

Accordingly, the primary object of the present invention is to provide an umbrella with a switch for folding and opening an umbrella automatically, which has a simple structure and thus the costs in manufacturing and maintenance.

To achieve above objects, the present invention provides a switch for folding and opening an umbrella automatically comprising an engaging tube having a first spring and a second spring, and a buckle; one end of the engaging tube has a tube; a lateral side of the tube having a protrusion; two outer lateral sides of the engaging tube being installed with parallel lateral sides; a button for covering the engaging tube being exactly located upon the receiving space; a central post, a third spring, and a movable block being pivotally installed in the sliding groove, wherein the movable block can slid on the central post freely; a sleeve being a hollow tube for receiving the engaging tube; a post being protruded from another end; an embedding hole being installed on the post at the connection to the wall of the sleeve; an outer edge of the post is installed with an embedding body; and a handle being inserted by the sleeve; and the blind hole being formed with an embedding seat for being embedded by the embedding body. By above simple structure, the umbrella can be opened and folded easily. Further, by engagement of protrusion and embedding hole and the lateral side, the engaging tube and sleeve are combined. The alignment is performed easily and the time is saved.

The various objects and advantages of the present invention will be more readily understood from the following detailed description when read in conjunction with the appended drawing.

DETAILED DESCRIPTION OF THE PREFERRED EMBODIMENTS

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
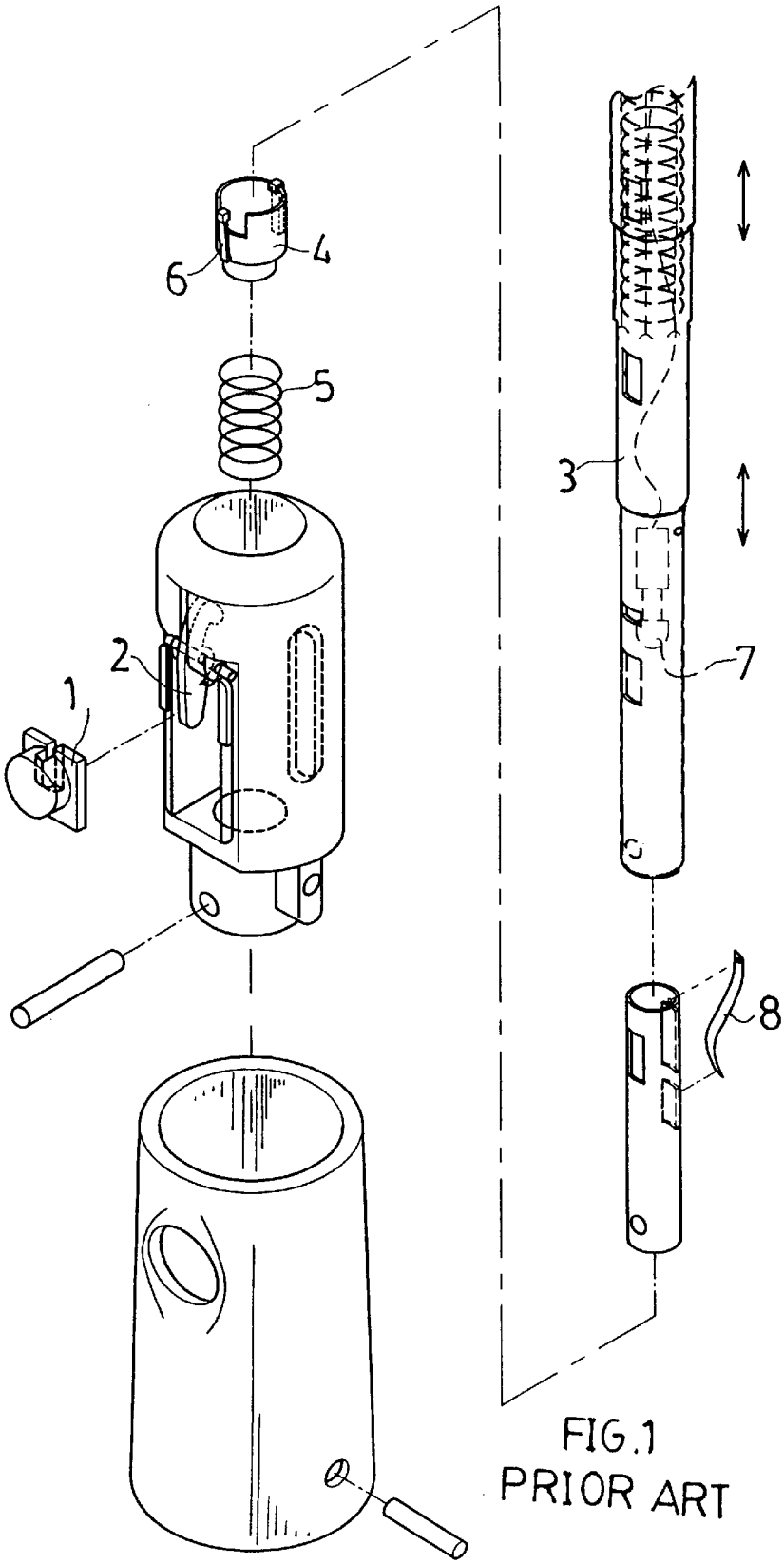
FIG.1 PRIOR ART
FIG. 1 is an exploded perspective view of a prior umbrella.
Figure 2:
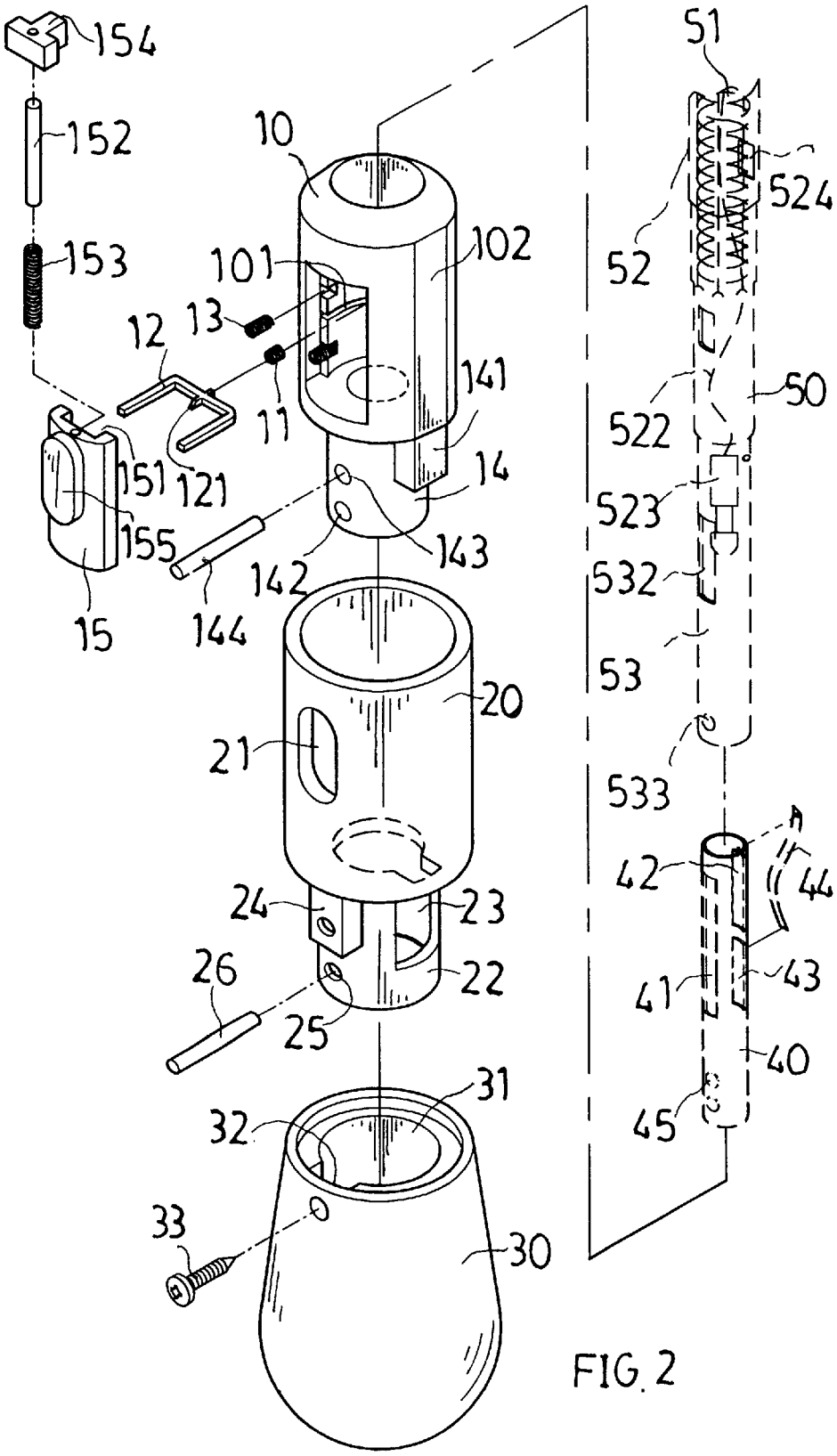
FIG. 2 is an exploded perspective view of the present invention.
Figure 4A:
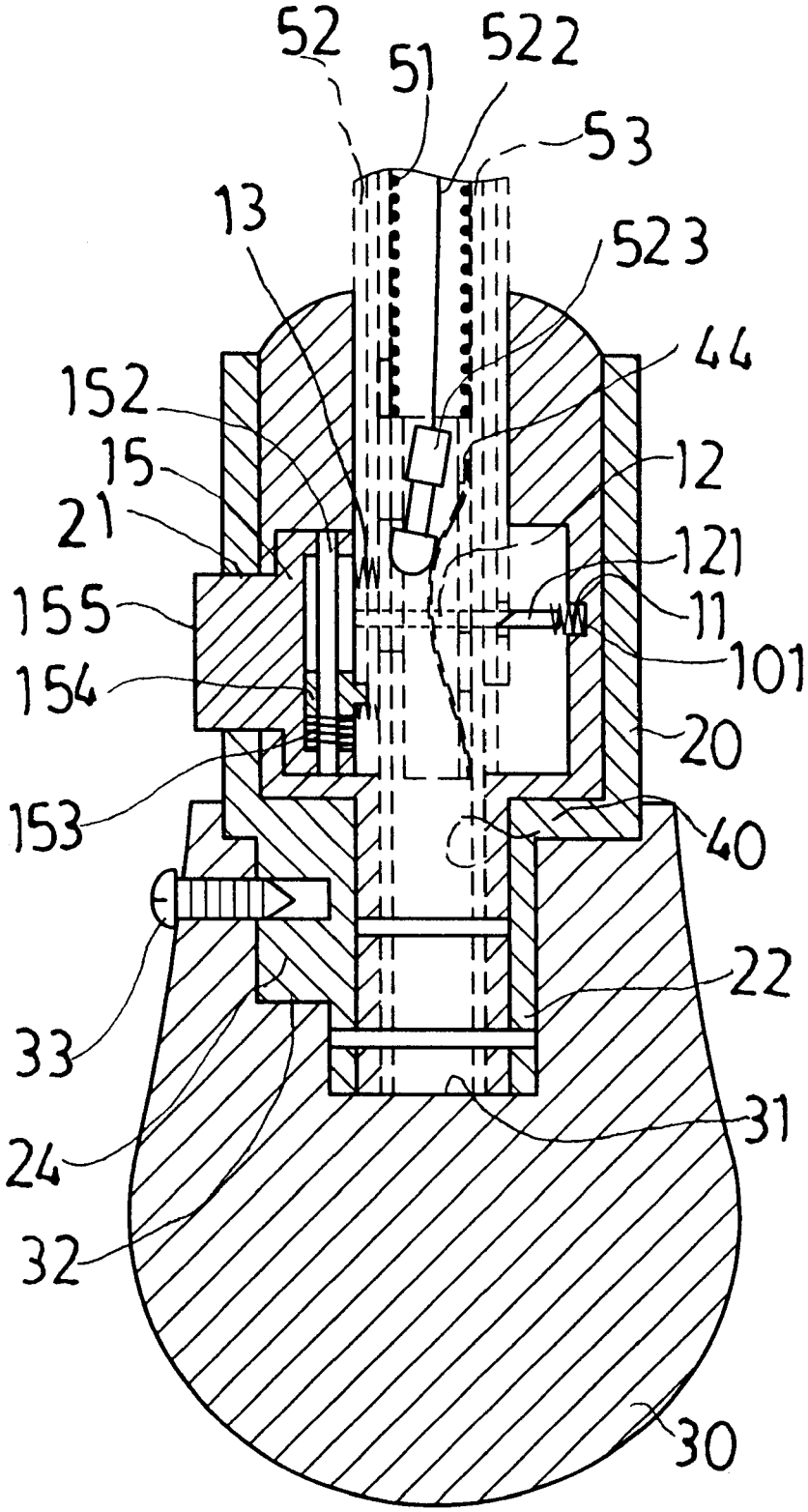
FIG. 4A is a cross sectional view of the line 4—4 in FIG. 3.
Figure 4B:
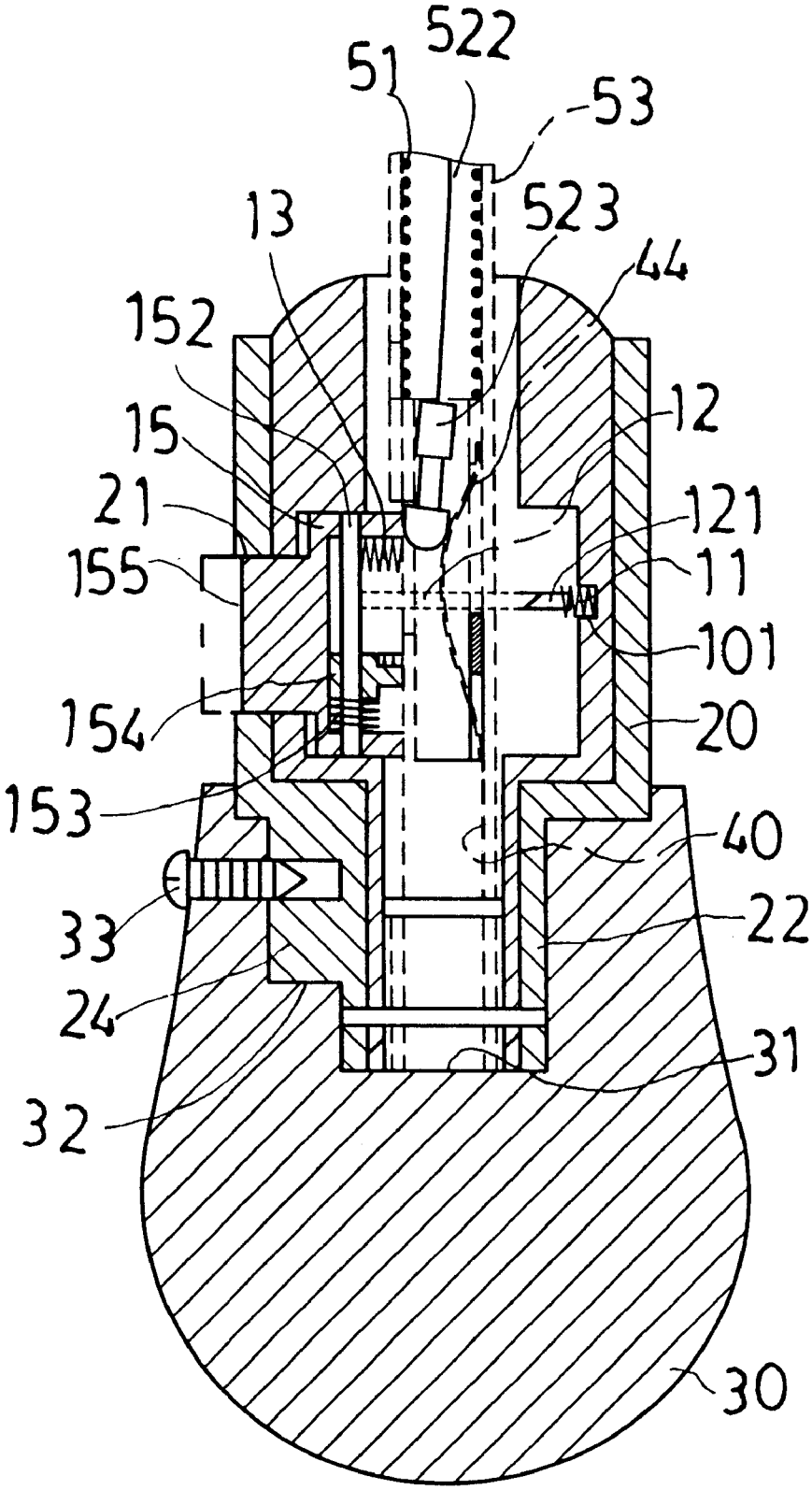
FIG. 4B is a schematic view showing an operation of FIG. 4A.
Figure 4C:
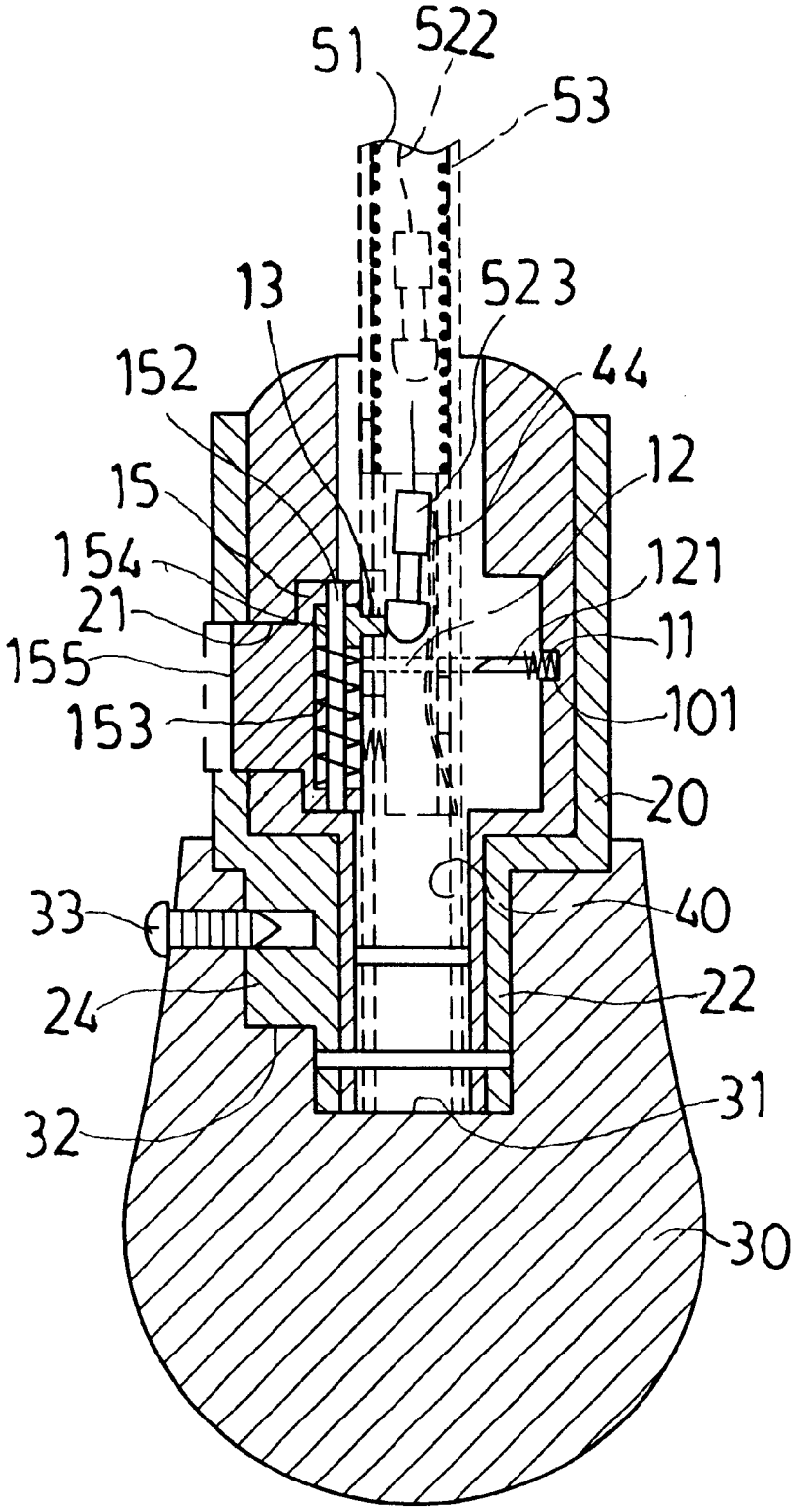
FIG. 4C is a schematic view showing another operation of FIG. 4A.

Referring to FIGS. 2 and 4C, the present invention mainly comprises the following components.

An engaging tube 10 has a receiving space at the center thereof. A groove 101 is formed at a wall of the receiving space. The groove 101 is placed with a first spring 11 and a buckle 12. The buckle 12 has a U shape and has an nose 121 with sloping edge. By the elastic force of the first spring 11, the buckle 12 moves upwards and downwards in the groove 101. Walls of the receiving space at two sides of the groove 101 is installed with a plurality of second springs 13. One end of the engaging tube 10 has a tube 14. The lateral side of the tube 14 has a protrusion 141. Two outer lateral sides of the engaging tube 10 are installed with parallel lateral sides 102 and penetrating holes 142 and 143 are installed at a distal end of the tube 14.

A button 15 for covering the engaging tube 10 is exactly located upon the receiving space. A sliding groove 151 is at the inner surface of a button 15. A central post 152, a third spring 153, and a movable block 154 are pivotally installed in the sliding groove 151. The movable block 154 may slide on the central post 152 freely. Another, a pressing portion 155 is protruded from the button 15.

A sleeve 20 has a hollow tube for receiving the engaging tube 10. A though hole 21 is formed at a position with respect to the button 15. The pressing portion 155 of the button 15 protrudes out. Similarly, a post 22 is protruded from a lower end of the sleeve 20. An embedding hole 23 is installed on the post 22 at the connection to the wall of the sleeve 20 for being embedded by the protrusion 141 of the engaging tube 10 so that the engaging tube 10 and sleeve 20 are engaged integrally. An outer surface of the post 22 is formed with an embedding body 24. A distal end of the post 22 is formed with a penetrating hole 25. A fixing lock 26 penetrates through the penetrating hole 142 of the engaging tube 10 and the penetrating hole 25 of the post 22.

A handle 30 has an end being formed with a blind hole 31 for being inserted by the sleeve 20. The blind hole 31 is formed with an embedding seat 32 for being embedded by the embedding body 24. A locking screw 33 at the outer edge of the seat 32 serves to penetrate through the embedding body 24 of the sleeve 20.

Moreover, the following prior art structure is used in the structure of the present invention.

A rib tube 40 penetrates through the tube 14 of the engaging tube 10. The center near the front end of the rib tube 40 has a transversal tube 41 and another side with respect to the transversal tube 41 has two long holes 42 and 43 which have different lengths. A pressing spring 44 is installed in the long holes 42 and 43. A distal end of the rib tube 40 is installed with a locking hole 45.

An umbrella frame 50 is firmly secured to the distal end of the engaging tube 10. The umbrella frame 50 is installed with a resilient spring 51 therein and the umbrella frame 50 is formed with an outer umbrella frame 52 and an inner umbrella frame 53. A top of the outer umbrella frame 52 is formed with a pulley 521 and is passed by a rope 522. One end of the rope 522 is firmly secured to the top of the umbrella frame 50, while another end thereof is installed with a buckling head 523 which is vertically located in the umbrella frame 50. Near a distal end of the inner umbrella frame 53 is installed with a concave hole 532 and a locking hole 533.

Figure 3:
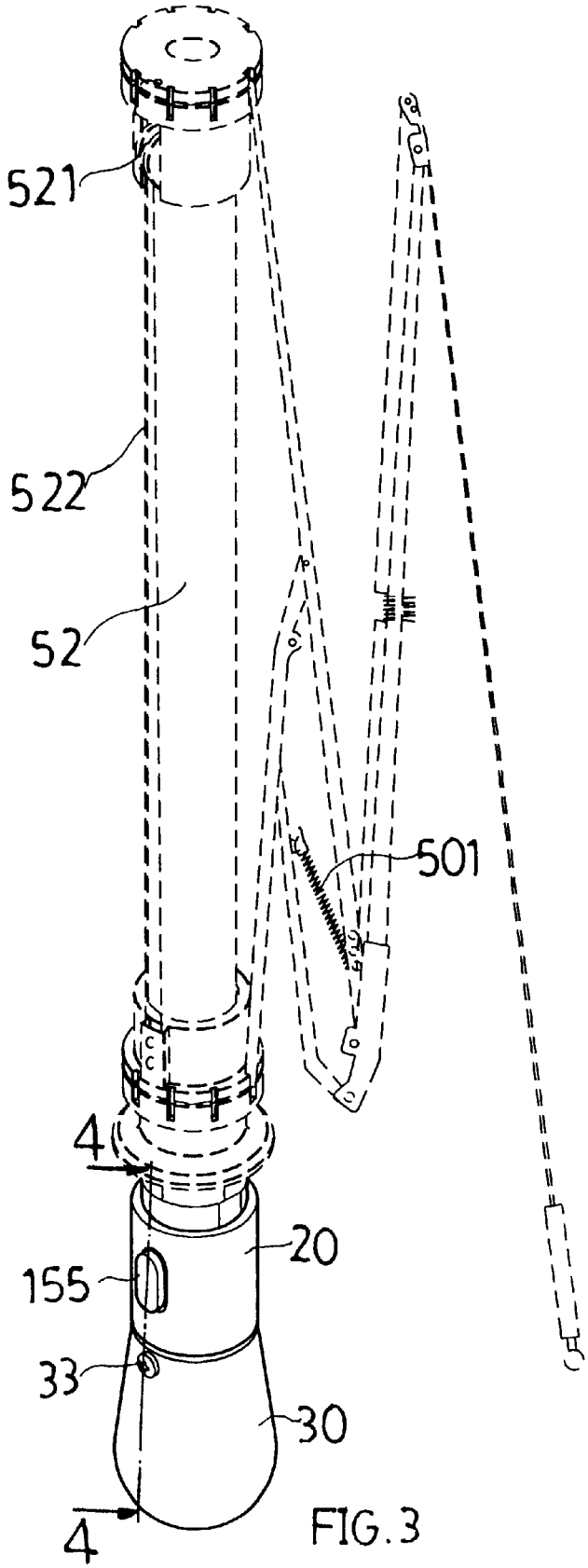
FIG. 3 is an assembled perspective view of the present invention.

In assembly, referring to FIG. 3, initially, the buckle 12 and a first spring 11 are located in the groove 101 of the engaging tube 10. Then, the rib tube 40 is inserted into the umbrella frame 50. Then the umbrella frame 50 passes through the tube 14 of the engaging tube 10. By inserting a pin 144, the sliding groove 151, central post 152 and third spring 153 are assembled in the button 15, and the engaging tube 10 is inserted into the sleeve 20. By the protrusion 141 embedding into the embedding hole 23, the engaging tube 10 is easily inserted into the sleeve 20 without needing to align the two. Finally, by the embedding body 24 to embed into the embedding seat 32, the sleeve 30 be engaged with the handle 30. Then, a locking screw 33 is used to penetrate through the embedding body 24 of the sleeve 20 for locking the two.

Referring to FIGS. 4A, 4B, and 4C, if it is desired to open the umbrella, the button 15 must be pressed so that the buckle 12 is pressed downwards, the nose 121 is separated from the notch 524 at the frame 52. The resilient spring 51 will eject the frame 52 out to open the umbrella. The buckle head 523 of rope 522 in the umbrella frame 50 is remain in the transversal hole 41 in the tube 40. By the elastic piece 44 in the tube 40 to buckle the buckle head 523 of the transversal hole 41, then umbrellas will be opened, while the movable block 154 returns to the original position by the third spring 153 so that the movable block 154 is pushed to a front position. Thus, the action of opening an umbrella is complete.

If it is desired to fold the umbrella, the button 15 is pressed further so that the button 15 is pressed downwards toward the movable block 154. Meanwhile, the buckle head 523 and the elastic piece 44 are resisted so that the buckle head 523 is released and is pulled out easily from a rope 522 at one end of the buckle head 523. The umbrella will be received rapidly by the spring 501 in the frame 50 so that the umbrella is received. Then, the umbrella is received downwards toward the handle 30 so that the inner umbrella frame 53 is inserted from the front end of the tube 10. At the time of moving the movable block 154 inwards, The nose 121 of the buckle 12 re-hooks the notch 524 of the outer umbrella frame 52 so that the umbrella is folded.

By above operation step, the present invention has the following advantage:

1. In the engaging tube 10 of the present invention, by simple elements of such as buckle 12, movable block 154 and button 15, the umbrella can be opened and closed easily.
2. In the present invention, by engagement of protrusion 141 and embedding hole 23 and the lateral side 102, the engaging tube 10 and sleeve 20 are combined. The alignment is performed easily and the time is saved.
3. In the present invention, the sleeve 20 and handle 30 are aligned easily and thus are combined. Another, the engagement of the embedding body 24 and the embedding seat 32, the same effect is achieved.
4. In the present invention, the sleeve 20 enclosing the engaging tube 10 and a handle 30 is added to the handle 30, the umbrella can be hold and operated freely.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A switch for folding and opening an umbrella automatically, comprising:

an engaging tube having a receiving space at a center thereof; the receiving space being installed with a first spring and a second spring, and a buckle; one end of the engaging tube having a tube; a lateral side of the tube having a protrusion; two outer lateral sides of the engaging tube being formed with parallel lateral sides;

a button for covering the engaging tube being exactly located upon the receiving space; a central post, a third spring, and a movable block being pivotally installed in a sliding groove at an inner surface of the button, wherein the movable block can slid on the central post freely;

a sleeve being a hollow tube for receiving the engaging tube; a post being protruded from a lower end of the sleeve; an embedding hole being formed on the post at a connection to a wall of the sleeve; an outer surface of the post is formed with an embedding body; and a handle being inserted by the sleeve; and the handle having a blind hole being formed with an embedding seat for receiving and securing the embedding body of the sleeve to the handle.

2. The switch for folding and opening an umbrella automatically as claimed in claim 1, wherein a groove is formed at a wall of the receiving space; the groove is placed with the first spring, and the buckle.

3. The switch for folding and opening an umbrella automatically as claimed in claim 1, wherein the buckle has a U shape and has an nose with a sloping edge at a center thereof.

4. The switch for folding and opening an umbrella automatically as claimed in claim 1, wherein the sliding groove is formed at an inner surface of the button for being pivotally installed with the central post, the third spring, and the movable block.

* * * * *